US006895675B2

(12) United States Patent
Albright et al.

(10) Patent No.: US 6,895,675 B2
(45) Date of Patent: May 24, 2005

(54) APPARATUS AND METHODS FOR MEASURING THE MOVEMENT OF A STRAIGHTEDGE TO DRAW LINES OR CUT STRIPS OF A FLAT MATERIAL

(75) Inventors: Alto Albright, 818 16$^{th}$ Ave. W., Kirkland, WA (US) 98033; Sam Albright, 4132 Hanson Rd., Ellensburg, WA (US) 98926

(73) Assignees: Alto Albright, Kirkland, WA (US); Sam Albright, Ellensburg, WA (US)

( * ) Notice: Subject to any disclaimer, the term of this patent is extended or adjusted under 35 U.S.C. 154(b) by 0 days.

(21) Appl. No.: 10/350,860

(22) Filed: Jan. 23, 2003

(65) Prior Publication Data

US 2004/0143979 A1 Jul. 29, 2004

(51) Int. Cl.$^{7}$ ..... B43L 13/00

(52) U.S. Cl. ..... 33/42; 33/418; 33/425; 33/472

(58) Field of Search ..... 33/42, 466, 418–419, 33/424–426, 430, 437, 452, 465, 470–473

(56) References Cited

U.S. PATENT DOCUMENTS

| | | | | | |
|---|---|---|---|---|---|
| 58,056 | A | | 9/1866 | Bronson | |
| 1,045,695 | A | | 11/1912 | Goldwater | |
| 1,381,808 | A | | 6/1921 | Davis | |
| 1,983,516 | A | * | 12/1934 | Ahola | 33/419 |
| 2,187,574 | A | | 1/1940 | Nigra | |
| 2,327,223 | A | | 8/1943 | Silver | |
| 2,423,786 | A | | 7/1947 | Morris | |
| 2,517,264 | A | * | 8/1950 | Wake | 33/419 |
| 2,790,498 | A | | 4/1957 | Carscallen | |
| 3,077,805 | A | | 2/1963 | Stanley | |
| 4,030,192 | A | | 6/1977 | Umholtz | |
| 4,038,751 | A | | 8/1977 | Albright | |
| 4,102,050 | A | | 7/1978 | Roth | |
| 4,158,977 | A | | 6/1979 | Logan | |
| 4,176,452 | A | | 12/1979 | Duggins et al. | |
| 4,233,736 | A | | 11/1980 | Duggins et al. | |
| 4,262,419 | A | | 4/1981 | Pierce | |
| 4,339,877 | A | | 7/1982 | Pierce | |
| 4,380,872 | A | * | 4/1983 | Moran | 33/529 |
| 4,382,616 | A | | 5/1983 | Olivieri | |
| 4,413,542 | A | | 11/1983 | Rempel | |
| 4,449,304 | A | | 5/1984 | Underwood | |
| 4,470,201 | A | | 9/1984 | Lindquist | |
| 4,577,415 | A | | 3/1986 | Schiller | |
| 4,611,406 | A | | 9/1986 | Engstrom et al. | |
| 4,685,366 | A | | 8/1987 | Beder | |
| 4,697,351 | A | | 10/1987 | Hopfer | |
| 4,779,346 | A | | 10/1988 | Schafer | |
| 4,866,847 | A | | 9/1989 | Baltrack et al. | |
| 4,867,023 | A | | 9/1989 | Kozyrski et al. | |
| 4,871,156 | A | | 10/1989 | Kozyrski et al. | |
| 4,875,667 | A | | 10/1989 | Schafer | |
| D304,808 | S | | 11/1989 | Carithers, Jr. | |
| 5,226,238 | A | * | 7/1993 | Rahnefeld | 33/419 |
| 5,271,305 | A | | 12/1993 | Peters et al. | |
| 5,461,794 | A | * | 10/1995 | Huang | 33/470 |
| 5,845,409 | A | | 12/1998 | Kimoto | |
| 6,182,549 | B1 | | 2/2001 | Albright et al. | |
| 6,260,283 | B1 | * | 7/2001 | Abernathy et al. | 33/419 |
| 6,330,752 | B1 | * | 12/2001 | Ellam | 33/471 |
| 6,694,633 | B1 | * | 2/2004 | Nyquist | 33/452 |

* cited by examiner

*Primary Examiner*—Christopher W. Fulton
*Assistant Examiner*—Yaritza Guadalupe
(74) *Attorney, Agent, or Firm*—Black Lowe & Graham, PLLC

(57) ABSTRACT

Novel measuring and cutting apparatus and methods are disclosed. In one embodiment, an apparatus includes a base member, an elongated member having an attachment end coupled to the base member and at least one straight edge adapted to extend over a workpiece, and a measuring arm. The measuring arm includes a first leg slideably coupled at right angles to the elongated member, and a second leg extending from the first leg and adapted to extend over the workpiece, the measuring arm defining a distance between the straight edge and the second leg. The apparatus allows accurate, repeated measurement when the straightedge is angled, and also allows access to the entire length of the straightedge for drawing or cutting.

20 Claims, 7 Drawing Sheets

APPARATUS AND METHODS FOR MEASURING THE MOVEMENT OF A STRAIGHTEDGE TO DRAW LINES OR CUT STRIPS OF A FLAT MATERIAL

TECHNICAL FIELD

The present invention is directed to apparatus and methods for measuring, marking, and cutting flat articles, and more specifically, toward apparatus and methods for measuring the movement of a straightedge to draw lines or cut strips of a flat material of the type that may be used, for example, in the art of quilting or other sewing crafts where repeated, accurate, parallel cuts or lines are made.

BACKGROUND OF THE INVENTION

Many types of craft projects require precise drawing or cutting of parallel lines, grids, or straight-sided geometrical shapes. Quilting involves sewing together many pieces of fabric to form a quilt or wall hanging. The fabric pieces are usually strips, rectangles or triangles cut to particular shapes and sizes. Because a large number of fabric pieces go into a quilt, each piece must be cut accurately to prevent errors in size of the fabric pieces. Failure to prevent such errors could result in a finished article that may not have the correct shape or size. In addition, inaccurately cut fabric pieces result in a needless waste of fabric and time. Blocks and strips of fabric for quilting are currently cut by placing the fabric upon a cutting pad, measuring with a ruler, manually holding a straightedge, and cutting against the straightedge with a cutting device. This method is slow and does not provide highly accurate cuts, because it is difficult to get a precise alignment manually, because it is time consuming and difficult to use a separate ruler to measure when cutting, and because the straightedge can easily slip under the user's hand during cutting. This method is also unsuitable for cutting many layers of fabric, and for repeat cutting of multiple pieces such as strips, squares or triangles.

A device described in U.S. Pat. No. 6,182,549 (Apparatus for Holding Flat Articles for Cutting) has a straightedge that operates similar to a drafting table and eliminates most of the problems associated with manually securing the straightedge for drawing or cutting. In the commercial product sold under said patent, a measuring arm attached to a straightedge assembly is slideably engaged to rails on the base board. The measuring arm on this device is limited to 90° and 45° settings and does not freely move to any angle with the straightedge, thus restricting its use.

In German Patent No. DE 30 05 422 A1, a device is described that will measure a distance from the straightedge with the straightedge set at any angle, but this device is limited in the width of measurement and restricts access to the edge of the straightedge for drawing or cutting. The German device uses a turnable "adjustment piece" combined with a "guiding element" that slides along the ruler. This device is designed to measure from the edge of a ruler for the drawing of hatched lines. This design will not allow the use of a cutting device along the ruler without removing the "guiding element" for each cut.

In U.S. Pat. No. 2,423,786, a pivotable T-square device has a secondary ruler slideably engaged in an alignment slot along the longitudinal axis of the main ruler and extending at right angles to said ruler. This secondary ruler measures at right angles from the edge of the straightedge, but does not allow access to the edge of the main straightedge for drawing or cutting.

In U.S. Pat. No. 1,045,695, a similar problem arises. A secondary ruler, slideably engaged to the main straightedge can be used when the straightedge is angled, but does not allow access to the straightedge for drawing or cutting along its length.

Similarly in U.S. Pat. No. 4,697,351, the device employs a secondary, adjustable ruler at right angles to the main straightedge. This secondary ruler can measure a distance from the main ruler, however, it unduly restricts access to the main straightedge for drawing or cutting.

Furthermore, U.S. Pat. No. 5,226,238 discloses a device that aligns and measures from an edge at various angles, but has no means to measure a secondary measurement from the edge of the main straightedge.

Numerous other examples of measuring, drawing and cutting aids are known in the existing art. For example, U.S. Pat. No. 4,449,304 (Underwood 1984), U.S. Pat. No. 5,845,409 (Kimoto 1998), U.S. Pat. No. 5,915,807 (Ilagan 1999), U.S. Pat. No. 1,045,695 (Goldwater 1912) U.S. Pat. No. 2,423,786 (Morris 1947), U.S. Pat. No. 5,226,238 (Rahnfeld 1993), U.S. Pat. No. 4,736,524 (King 1988), U.S. Pat. No. 1,381,808 (Davis 1921), U.S. Pat. No. 227,844 (Salot 1880), U.S. Pat. No. 58,056 (Bronson 1866), U.S. Pat. No. 1,773,809 (Elder 1930) and U.S. Pat. No. 591,964 (Gilcrest 1897), provide examples of protractor, straightedge, drawing instrument combinations in the existing art. These prior art devices, however, generally do not provide a way to measure from the edge of the straightedge while the straightedge is angled while also providing unrestricted access to the edge of the straightedge for drawing or cutting. Therefore, there is a continuing need for devices providing this capability for applications such as quilting or other crafts where repeated, accurate, parallel cuts or lines are made.

BRIEF SUMMARY OF THE INVENTION

Apparatus and methods of measuring, marking, and cutting flat articles are disclosed. In one embodiment, an apparatus includes a base member, an elongated member having an attachment end coupled to the base member and at least one straight edge adapted to extend over a workpiece, and a measuring arm. The measuring arm includes a first leg slideably coupled at right angles to the elongated member, and a second leg extending from the first leg and adapted to extend over the workpiece, the measuring arm defining a distance between the straight edge and the second leg. Apparatus in accordance with the present invention may be used to quickly and efficiently perform measuring, marking and cutting operations for a wide variety of applications, including measuring and cutting fabric pieces for crafts projects such as quilting, measuring and trimming photographic prints, or even as a drafting aid for drawing parallel lines at various angles.

DETAILED DESCRIPTION OF THE INVENTION

The present invention is directed toward apparatus and methods for measuring, marking, and cutting flat articles, and more specifically, toward apparatus and methods for measuring the movement of a straightedge to draw lines or cut strips of a flat material. In the following description and the enclosed figures, numerous specific details are set forth to provide a thorough understanding of the present invention. A person of ordinary skill in the art, however, will recognize that the present invention may have additional embodiments, and can be practiced without one or more of the specific details described herein.

Figure 1:
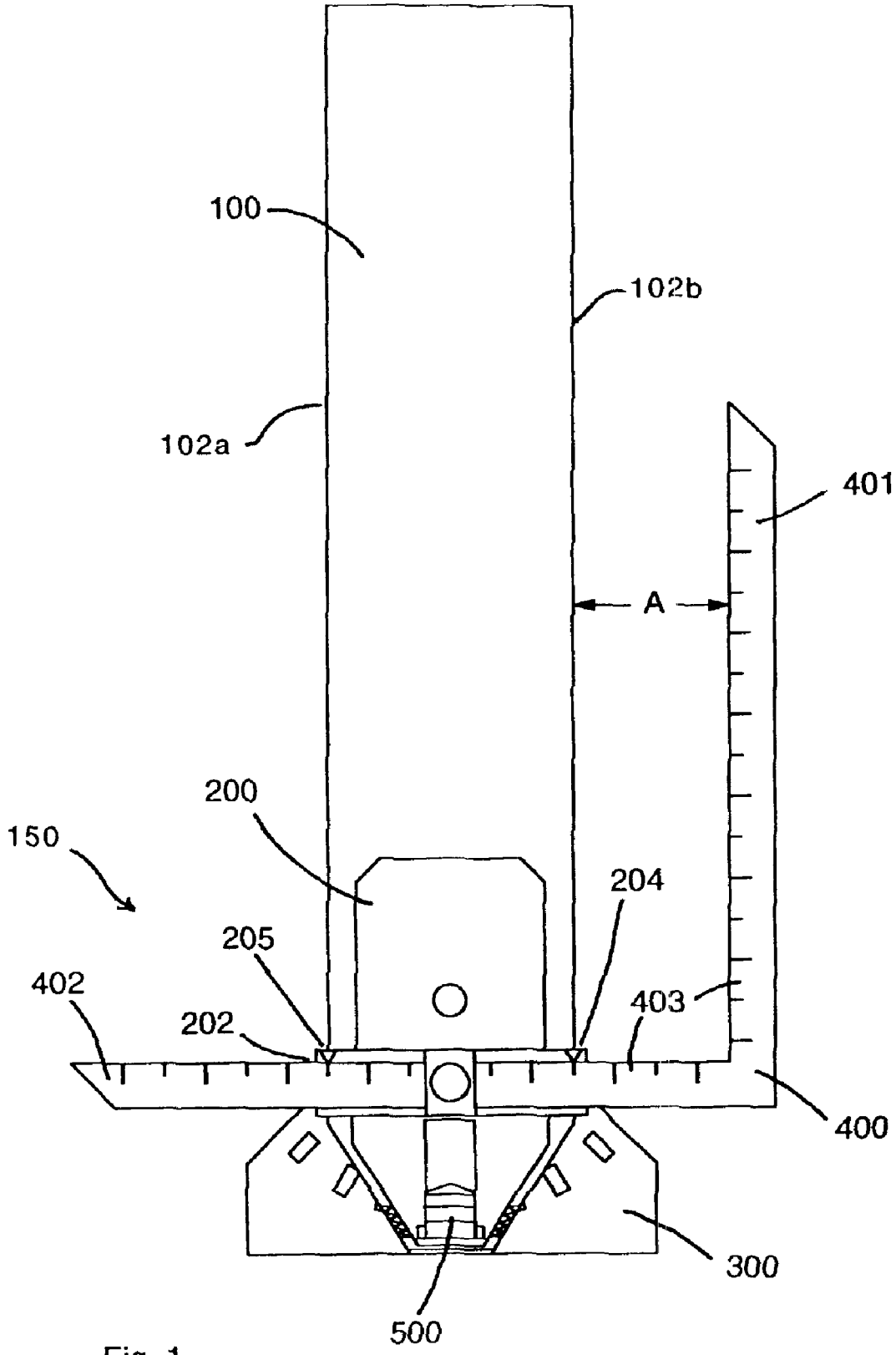
FIG. 1 is a top plan view of an angling T-square device in accordance with an embodiment of the present invention.

With reference to FIG. 1, an assembly in accordance with an embodiment of the invention includes a straightedge 100 attached to a pivotable head 200, that is in-turn pivotably engaged to a protractor base 300. In this embodiment, the straightedge 100 is a substantially flat rectangular member having a pair of elongated left and right edges 102*a*, 102*b*. The head 200 and straightedge 100 are combined to form a head/straightedge assembly 150 that is pivotable with respect to the base 300. A substantially L-shaped measuring arm 400 is slideably attached to the head/straightedge assembly 150, as described more fully below. A latch 500 (preferably spring-actuated) allows the head/straightedge assembly 150 to be indexed at various angles with respect to the base 300.

Figure 2:
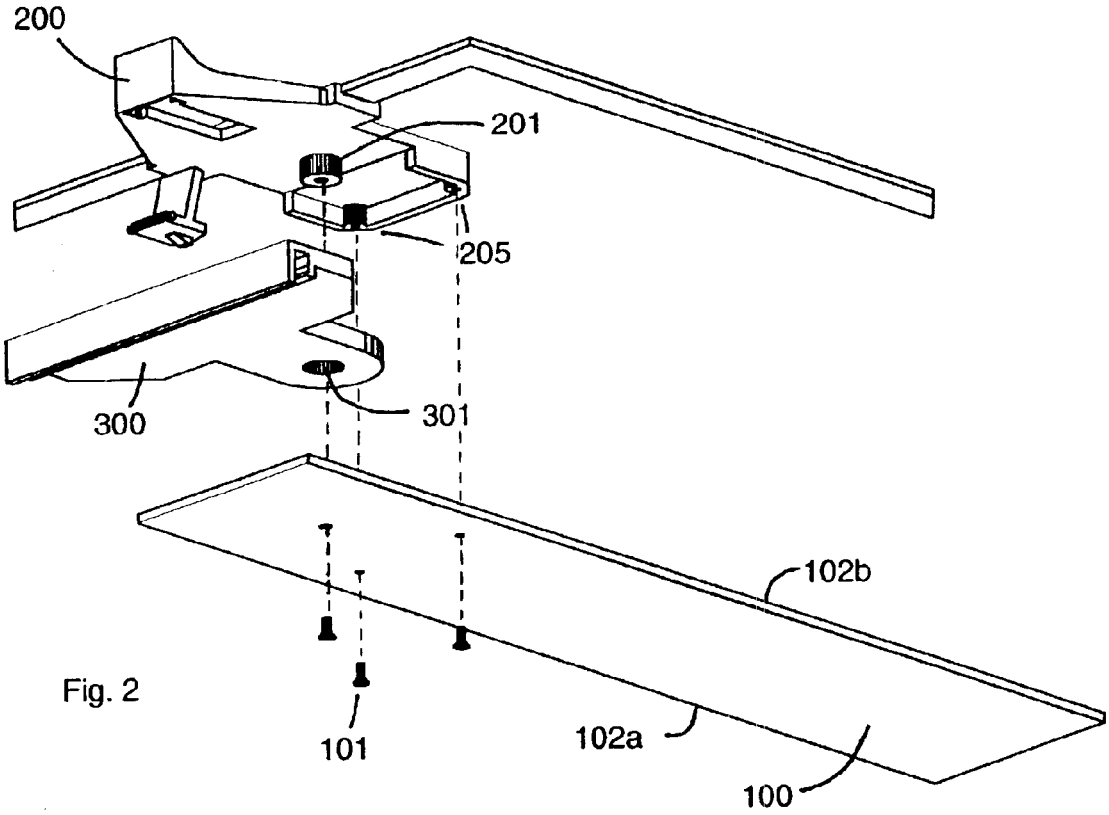
FIG. 2 is a lower exploded view of the angling T-square device of FIG. 1.
Figure 3:
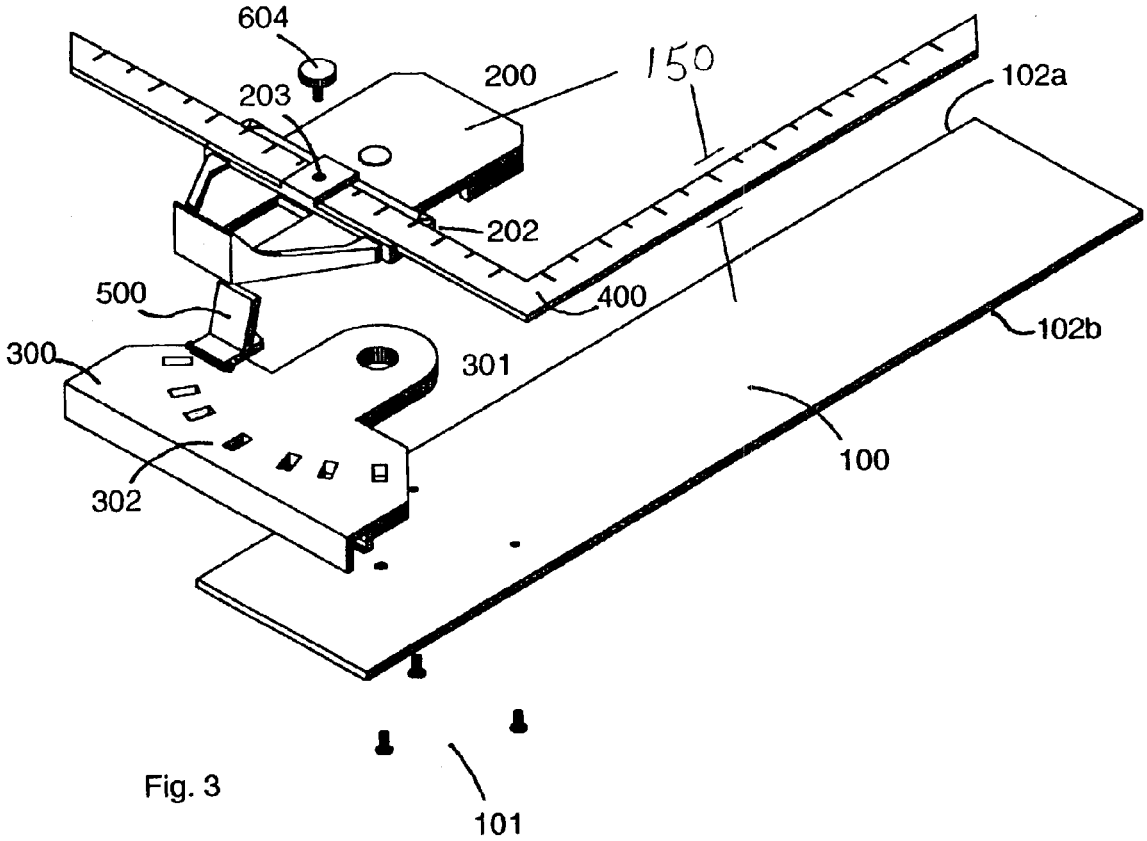
FIG. 3 is an upper exploded view of the angling T-square device of FIG. 1.

As shown in FIG. 2, to facilitate the angular adjustment of the device, the head 200 has a boss 201 that is pivotably engaged with a hole 301 in the protractor base 300. Screws 101 extend through the straightedge 100 and engage into holes 205 disposed in the head 200, securing the base 300 and the straightedge 100 to the head 200 while allowing the base 300 to pivot around the boss 201. With reference to FIG. 3, to facilitate the specific angular alignment of the head/straightedge assembly 150 to the base 300, the latch 500 engages a plurality of indentations 302 disposed in the protractor base 300. To facilitate measurements of distances from the edges 102 of the straightedge 100, a L-shaped measuring arm 400 is slideably engaged with a dadodado 202 in the head 200. In this embodiment, the dadodado 202 is positioned at right angles to the longitudinal axis of the straightedge 100 and facilitates the alignment of the measuring arm 400 to the pivotable head/straightedge assembly 150. As further shown in FIG. 3, a thumbscrew 604 is threadably engaged with a hole 203 in the head 200. Tightening the thumb screw 604 secures the measuring arm 400 into the dadodado 202. Unscrewing the thumbscrew 604 releases the pressure on the measuring arm 400 allowing it to be readjusted.

With reference to FIG. 1, in this embodiment, the measuring arm 400 includes a pointer leg 401 that extends alongside, and substantially parallel to the straightedge 100. In operation, the pointer leg 401 extends over the article being measured, allowing measurements (A) to be made anywhere along its length while allowing clear access to the entire length of the edges 102 of the straightedge 100.

The measuring arm 400 also includes a scale leg 402 that slides in the dado 202 and has a scale 403 imprinted thereon. The scale 403 facilitates the measurement between the pointer leg 401 and the corresponding edge 102 of the straightedge 100. Pointers 204 and 205 of the head 200 are in alignment with the corresponding edges 102 of the straightedge 100. To measure the desired width (A) from the right side edge 102*b* of the straightedge 100, the scale leg 402 of the measuring arm 400 is slid through the dado 202 until the scale 403 is aligned at the desired measurement to the pointer 204. Measurements from the left side edge 102*a* of the straightedge 100 may be obtained by removing the scale leg 402 from the dado 202, rotating the measuring arm 400 90°, and inserting the pointer leg 401 into the dado 202 from the left, aligning the scale 403 to the pointer 205 that corresponds to the left edge 102*a* of the straightedge 100.

Figure 4:
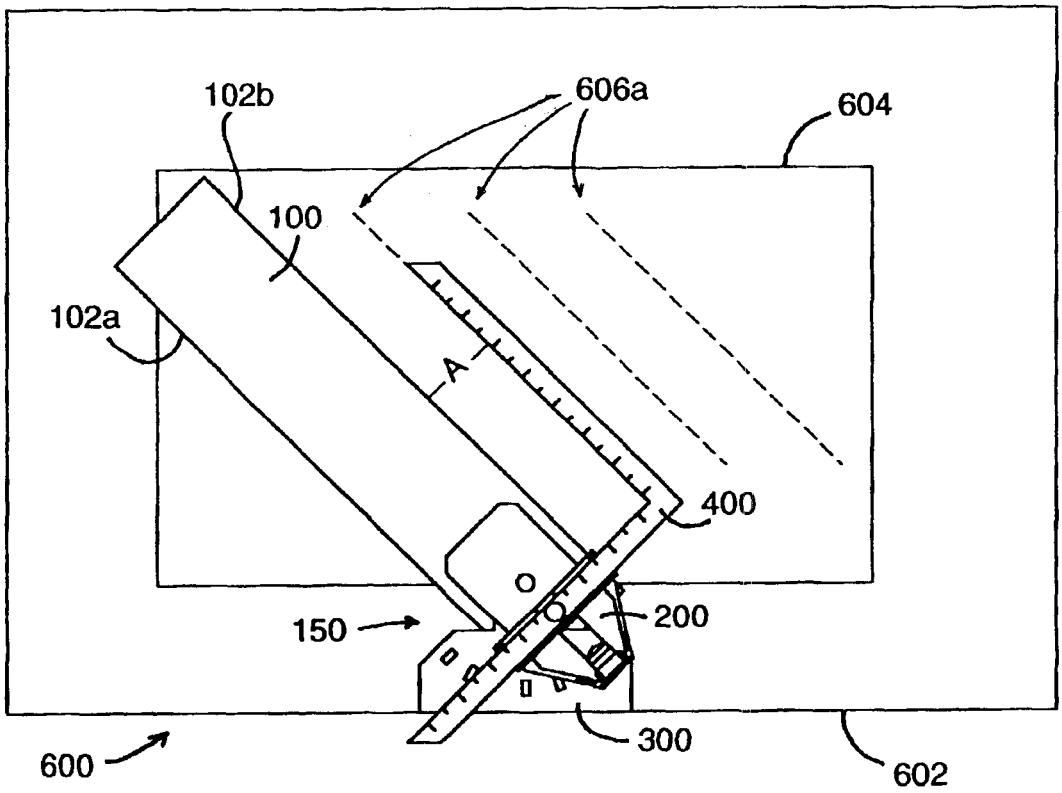
FIG. 4 is a top plan view of the device shown in FIG. 1 set at 45° referenced against the edge of a drawing/cutting board and drawing a series of angled parallel lines or cuts.

With reference to FIG. 4, in operation, the measuring arm 400 pivots with the head/straightedge assembly 150. This unique configuration allows the measuring arm 400 to make measurements (A) of distances projecting outwardly from the edges 102 of the straightedge 100 while at any angle set by the protractor base 300 and pivoting head 200, while also providing a cutting device or drawing instrument unrestricted access to the entire length of the edges 102 of the straightedge 100. FIG. 4 also illustrates the apparatus engaged with an edge 602 of a drawing/cutting board 600 over the material (or workpiece) 604 being worked. In the embodiment shown in FIG. 4, the straightedge 100 is set at 45° and used to draw a series of parallel lines 606*a*. Alternately, as described more fully below with reference to FIGS. 6–8, the base 300 may be engageable in one or more slots disposed within the board 600.

One may note that alternate embodiments of the above-described measuring arm 400 may be readily conceived. For example, in alternate embodiments, the measure arm 400 may be U-shaped having first and second pointer legs 401 extending from both ends of the scale leg 402. Furthermore, the measuring arm 400 may be slideably engaged with the straightedge 100 at a location that is spaced apart from the base 300, such as at a distal end of the straightedge 100. In such a configuration, the pointer leg(s) 401 may extend downwardly from the scale leg 402 back toward the base 300. In further embodiments, the pointer leg 401 may be oriented at an angle with respect to the scale leg 402 at an angle other than the 90 degree angle shown in FIGS. 1–4. In still further embodiments, the pointer leg 401 may be have a non-straight edge, such as a curved or sawtoothed edge, to facilitate the drawing and cutting of non-straight lines and cuts.

Figure 5:
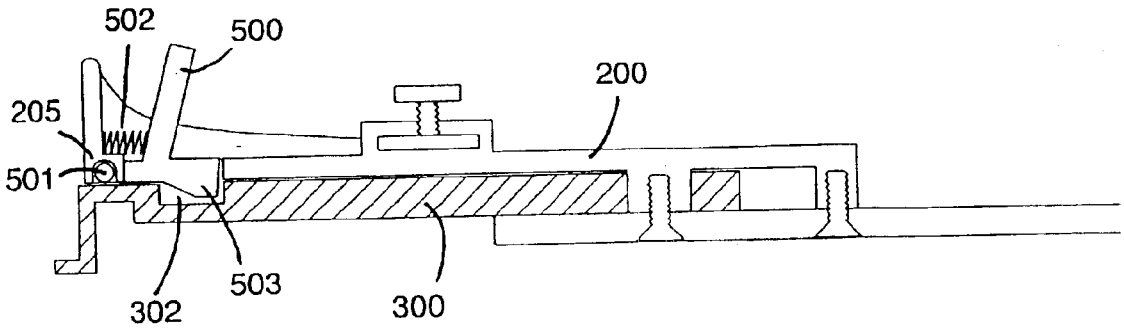
FIG. 5 is a partial cross-sectional side view of the angling T-square device of FIG. 1.

FIG. 5 is a side partial cross-sectional view of the apparatus of FIG. 1. As shown in FIG. 5, to facilitate the precise angular alignment of the head/straightedge assembly 150 with the protractor base 300, the latch 500 engages various angular alignment indentations 302 in base 300. Similarly, the latch 500 also pivotally engages the head 200 via two axle legs 501 captured in a slot 205 in the underside of the head 200. A coil spring 502 pushes on the latch 500 providing downward force for an alignment rib 503 to engage the angular alignment indentations 302 (FIG. 3) in the protractor base 300.

Figure 6:
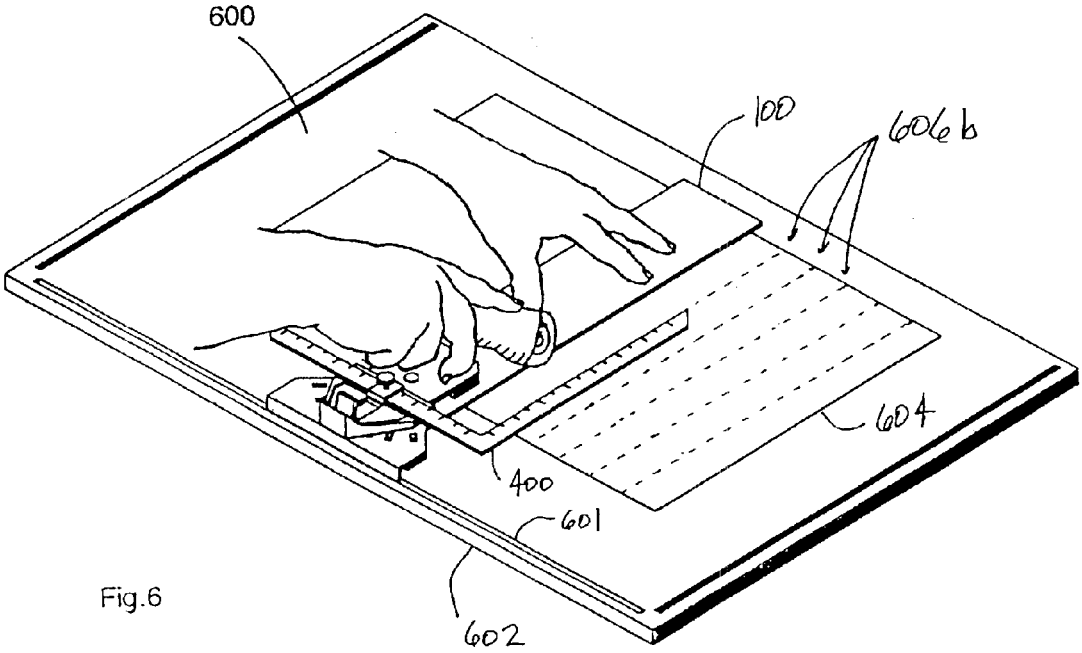
FIG. 6 is an isometric view of the device shown in FIG. 1 in operation engaged on a drawing/cutting board with slots around three sides.
Figure 7:
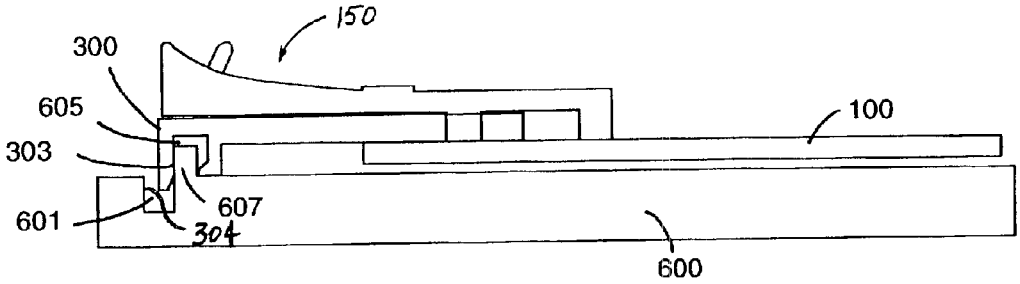
FIG. 7 is a side elevational view showing the device engaged with ribs in the drawing/cutting board of FIG. 6 in a lowered, fixed position.

FIG. 6 shows the novel device in operation, engaged with a slot 601 on the edge of the drawing/cutting board 600, cutting a series of parallel strips 606*b* from a flat material. As shown in FIG. 7, to facilitate the operation of this new device with existing, commercially-available cutting boards, including, for example, Model "QuiltCut" from Alto's EZ Mat Inc. of Ellensburg, Wash., the base 300 has an alignment edge 303 that slideably engages one or more slots 601 in the cutting board 600. Alternately, the base 300 may include an engagement slot 605 that slideably engages one or more guide ribs 607 (shown in dotted lines in FIGS. 7 and 8) projecting from the surface of the board 600.

Figure 8:
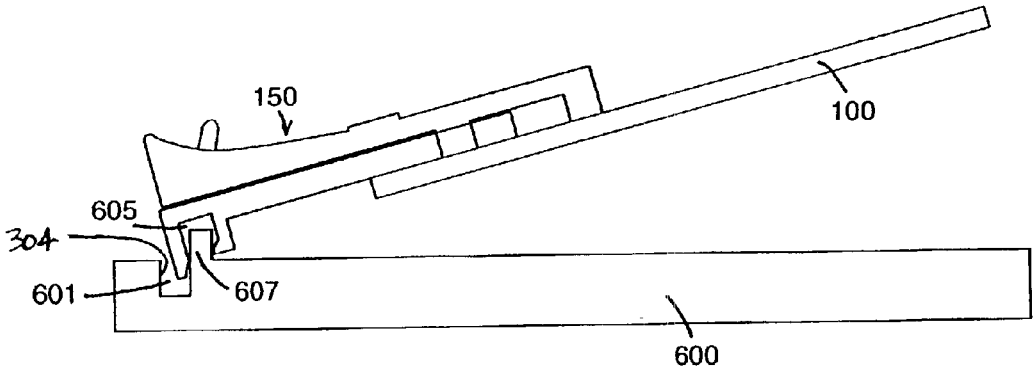
FIG. 8 is a side elevational view showing the described device engaged with ribs on the drawing/cutting board of FIG. 6 in a raised, released position.

FIG. 8 shows the straightedge 100 lifted to release pressure within the rib 607, allowing the head/straightedge assembly 150 to be readjusted. This novel configuration allows the device to be aligned against the edge of any straight-edged table, and for added accuracy and security, to operate with tables that include the appropriate slots or ribs around their periphery to facilitate the vertical and horizontal alignment of the straightedge 100.

As noted above, the inventive apparatus may be used to draw or cut parallel lines at various angles, and for various other types of similar operations in the field of quilting, sewing, or other arts that require the cutting of flat articles. In one embodiment, a method of operating the apparatus includes adjusting the scale leg 402 of the measuring arm 400 set to the desired measurement and the first line or cut 606 (FIGS. 4 and 6) is made. The entire apparatus is then slideably moved within the slot 601 until the pointer leg 401 of the measuring arm 400 is aligned to the first line or cut 606. A second line or cut may then be made the width of the measurement set on the scale leg 402 of the measuring arm 400. By repeatedly moving the apparatus and measuring with the measuring arm 400, a series of parallel lines or cuts 606 can be quickly and accurately made.

Also, by repositioning the apparatus in relation to the drawing/cutting table 600 and aligning it to a different side edge of the table 600, the straightedge 100 can be used to draw or cut perpendicularly to the first set of lines or cuts 606. This technique may be used to create a square grid of lines or cuts. By angling the straightedge 100 and using the measuring arm 400 for each repeated measurement, a grid of triangles, parallelograms, or other desired shapes can be drawn or cut. Apparatus in accordance with the present invention may be used for a wide variety of purposes, including measuring and cutting fabric pieces to specific sizes for crafts projects such as quilting, measuring and trimming photographic prints, or even as a drafting aid to measure the parallel movement of the straightedge 100 for drawing parallel lines at various angles.

The inventive apparatus described above and shown in the accompanying figures has numerous advantages over prior art devices. For example, the orientation of the measuring arm 400 with respect to the straightedge 100 allows a cutter or drawing instrument to have access to the entire length of the edges 102 of the straightedge 100 while the pointer leg 401 extends over the material being measured, greatly increasing the versatility and scope of application of the device.

Also, to facilitate right or left-handed use, there is second scale on the second leg 402 of the measuring arm 400 so that the measuring arm 400 can be rotated 90° and attached to the opposite side of the straightedge 100 to measure the distance from the left edge 102*a*. This configuration advantageously provides a user with the ability to accurately align the straightedge 100 and to measure the lateral movement in either direction from the edges 102 of the straightedge 100. Furthermore, because the straightedge 100 can pivot to various angles with respect to the base 300, and can move to various positions across the surface of the drawing/cutting board 600, the inventive apparatus provides greatly improved versatility and increased capability compared with prior art devices.

The detailed descriptions of the above embodiments are not exhaustive descriptions of all embodiments contemplated by the inventors to be within the scope of the invention. Indeed, persons of ordinary skill in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with the above-referenced patents, herein incorporated by reference to create additional embodiments within the scope and teachings of the invention. Thus, although specific embodiments and potential uses of the invention are described herein for illustrative purposes, various equivalent modifications are possible within the scope of the invention.

We claim:

1. An apparatus for performing measurements on a substantially flat workpiece positioned on a surface, comprising:

a base member engageable with the surface;

a rotatable assembly engageable with the base member, the rotatable assembly having a portion that includes a straightedge adapted to extend over the workpiece, at least a part of the rotatable assembly being rotatable with respect to the base member such that the straightedge is relocatable with respect to the base member; and a measuring arm including a first leg slideably coupled to the assembly and at right angles to the straightedge, and at least one second leg extending from and at a right angle to the first leg and adapted to extend over the workpiece to define a distance between the straightedge and the second leg, wherein the second leg is substantially parallel to the straightedge of the assembly and separated by the distance from the straightedge as determined by the position of the first leg.

2. The apparatus according to claim 1 wherein the first leg of the measuring arm is slideably coupled to the proximate end of the straightedge.

3. The apparatus according to claim 1 wherein the assembly further includes a boss that is pivotably coupled to the base member.

4. The apparatus according to claim 3 wherein the base member includes a hole to receive the boss.

5. The apparatus according to claim 1 wherein at least one of the first and second legs of the measuring arm has a scale on at least one surface thereof.

6. The apparatus according to claim 1 wherein the first leg of the measuring arm is slideably engaged within a slot in the assembly.

7. The apparatus according to claim 1 wherein the assembly includes a latch for controllably securing the straightedge in a desired position.

8. The apparatus according to claim 1, wherein the measuring arm is secured to the assembly by a screw that is threadably engaged with the first leg.

9. The apparatus according to claim 1, wherein the measuring arm includes at least one of an L-shaped configuration wherein the at least one second leg is substantially perpendicular to the first leg.

10. The apparatus according to claim 1 wherein the base member is slideably engageable with a groove in the surface.

11. The apparatus according to claim 1 wherein the surface comprises a substantially flat cutting/drawing board, and wherein the base member is slideably engageable with the substantially flat cutting/drawing board via a plurality of grooves disposed in the board.

12. The apparatus according to claim 1 wherein the base member is slideably engageable with at least one rib protruding from the surface.

13. The apparatus according to claim 1 wherein the base member includes at least one alignment rib.

14. An apparatus for performing measurements on a workpiece positioned on a board, comprising:

a base member engageable with the board;

a rotatable head assembly coupled with the base member;

a substantially flat straightedge adapted to extend over the workpiece and attached to the head assembly such that the straightedge is relocated with respect to the base member as the head assembly is rotated with respect to the base member; and an L-shaped measuring arm including a first leg slideably engaged with the head assembly to create a distance from the straightedge, and a second leg extending from and at a right angle to the first leg such that the second leg is substantially parallel to the straightedge, wherein pivoting of the head assembly maintains the second leg substantially parallel to the straightedge and separated by the distance created by the first leg.

15. The apparatus according to claim 14 wherein the first leg of the measuring arm is slideably coupled to the protractor head assembly proximate the first end of the straightedge.

16. The apparatus according to claim 14 wherein at least one of the first and second legs of the measuring arm includes a scale on at least one surface.

17. The apparatus according to claim 14 wherein at least one of the first and second legs of the measuring arm is slideably engaged within a groove in the protractor head assembly.

18. The apparatus according to claim 14 wherein at least one of the first and second legs of the measuring arm is slideably engaged with at least one raised rib on a surface of the protractor head assembly.

19. The apparatus according to claim 14 wherein at least one of the first and second legs of the measuring arm is secured to the protractor head assembly by a screw that is threadably engaged with the protractor head assembly.

20. The apparatus according to claim 14 wherein the head assembly further includes a latch engageable with a plurality of alignment indentations for establishing angular orientation.

* * * * *